US009157232B2

(12) United States Patent
Stahl, Jr.

(10) Patent No.: US 9,157,232 B2
(45) **Date of Patent: *Oct. 13, 2015**

(54) ADJUSTABLE HEAD-OF-WALL INSULATION CONSTRUCTION FOR USE WITH WIDER WALL CONFIGURATIONS

(71) Applicant: Specified Technologies Inc., Somerville, NJ (US)

(72) Inventor: James P. Stahl, Jr., Princeton Junction, NJ (US)

(73) Assignee: SPECIFIED TECHNOLOGIES INC., Somerville, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/120,001

(22) Filed: Apr. 14, 2014

(65) Prior Publication Data

US 2014/0360115 A1 Dec. 11, 2014

Related U.S. Application Data

(60) Provisional application No. 61/956,554, filed on Jun. 11, 2013.

(51) Int. Cl.
*E04C 2/00* (2006.01)
*E04B 2/74* (2006.01)

(52) U.S. Cl.
CPC ..... *E04B 2/7411* (2013.01); *E04B 2/7409* (2013.01); *E04B 2/7457* (2013.01)

(58) Field of Classification Search
CPC ..... E04B 2/7411; E04B 2/7409
USPC ..... 52/232, 241
See application file for complete search history.

(56) References Cited

U.S. PATENT DOCUMENTS

| | | | | |
|---|---|---|---|---|
| 4,103,463 | A * | 8/1978 | Dixon | 52/126.4 |
| 5,010,702 | A | 4/1991 | Daw et al. | |
| 5,127,203 | A | 7/1992 | Paquette | |
| 5,755,066 | A | 5/1998 | Becker | |
| 5,913,788 | A | 6/1999 | Herren | |
| 5,921,041 | A | 7/1999 | Egri, II | |
| 5,950,385 | A | 9/1999 | Herren | |
| 6,058,668 | A | 5/2000 | Herren | |
| 6,176,053 | B1 | 1/2001 | St. Germain | |
| 6,783,345 | B2 | 8/2004 | Morgan et al. | |
| 7,043,880 | B2 | 5/2006 | Morgan et al. | |
| 7,152,385 | B2 | 12/2006 | Morgan et al. | |
| 7,240,905 | B1 | 7/2007 | Stahl, Sr. | |
| 7,617,643 | B2 | 11/2009 | Pilz et al. | |
| 7,681,365 | B2 | 3/2010 | Klein | |

(Continued)

*Primary Examiner* — Basil Katcheves
(74) *Attorney, Agent, or Firm* — Fox Rothschild LLP

(57) ABSTRACT

A construction for insulating the head-of-wall joint between a wall and a floor or roof thereabove which utilizes an insulating gasket construction positionable between the ceiling track and the building structure thereabove. The insulating gasket member includes two L-shaped sections which includes co-operate to firestop both outwardly facing sides of a head-of-wall joint, but which can also be used singly. Each L-shaped section is attached to an associated side section which extends over the outwardly facing surfaces of a ceiling track with being attached thereto. Each L-shaped insulation gasket section can include securement mechanism such as adhesive on the undersurface of the main upper horizontal portion to facilitate attachment to the top of the track therebelow and can be attached to an adjacent similarly configured L-shaped section by one or more connecting straps extending through slits defined therein.

16 Claims, 11 Drawing Sheets

(56) References Cited

U.S. PATENT DOCUMENTS

| | | | |
|---|---|---|---|
| 7,752,817 | B2 | 7/2010 | Pilz et al. |
| 7,814,718 | B2 | 10/2010 | Klein |
| 7,866,108 | B2 | 1/2011 | Klein |
| 7,950,198 | B2 | 5/2011 | Pilz et al. |
| 8,087,205 | B2 | 1/2012 | Pilz et al. |
| 8,132,376 | B2 | 3/2012 | Pilz et al. |
| 8,281,552 | B2 | 10/2012 | Pilz et al. |
| 8,316,605 | B2 | 11/2012 | Oberg |
| 8,499,512 | B2 | 8/2013 | Pilz et al. |
| 8,555,566 | B2 | 10/2013 | Pilz et al. |
| 8,590,231 | B2 | 11/2013 | Pilz |
| 8,595,999 | B1 | 12/2013 | Pilz et al. |
| 8,640,415 | B2 | 2/2014 | Pilz et al. |
| 8,671,632 | B2 | 3/2014 | Pilz et al. |
| 8,826,599 | B2 * | 9/2014 | Stahl, Jr. ..... 52/1 |
| 2006/0137293 | A1 | 6/2006 | Klein |
| 2009/0090074 | A1 | 4/2009 | Klein |
| 2009/0178363 | A1 | 7/2009 | Pilz et al. |
| 2009/0223159 | A1 | 9/2009 | Colon |
| 2010/0126092 | A1 | 5/2010 | Pilz et al. |
| 2011/0011019 | A1 | 1/2011 | Stahl, Jr. et al. |
| 2011/0113709 | A1 | 5/2011 | Pilz et al. |
| 2011/0185656 | A1 | 8/2011 | Klein |
| 2011/0214371 | A1 | 9/2011 | Klein |
| 2011/0247281 | A1 | 10/2011 | Pilz et al. |
| 2013/0031856 | A1 | 2/2013 | Pilz et al. |
| 2013/0167456 | A1 | 7/2013 | Shapiro |
| 2013/0205694 | A1 | 8/2013 | Stahl, Jr. |

* cited by examiner

ADJUSTABLE HEAD-OF-WALL INSULATION CONSTRUCTION FOR USE WITH WIDER WALL CONFIGURATIONS

The present utility application hereby formally claims priority of currently U.S. Provisional Patent application No. 61/956,554 filed Jun. 11, 2013 on a "Head-of-Wall Insulation Means for Use With Wider Wall Constructions" filed naming the same inventor as listed herein, namely, James P Stahl Jr, and assigned to the same assignee as listed herein, namely, Specified Technologies Inc., and said referenced provisional application is hereby formally incorporated by reference as an integral part of the present application.

BACKGROUND OF THE INVENTION

1. Field of the Invention

The present invention pertains with the general field of acoustical or firestopping insulating including, possibly, intumescent or felt-type material components for resisting the spreading of fire, heat and smoke and, alternatively, inhibiting sound transmission therethrough. In the prior art various systems were utilized for the purposes of achieving insulation of head-of-wall joints but all have been proved to be inadequate for various reasons. For example, traditionally mineral wool has been installed or coatings or sealants have been applied in these in these areas for achieving firestop sealing and for acoustical sealing various different materials have been used to prevent sound transmission. Also, the use of tape which includes an intumescent component has been applied to the downwardly facing portion of outwardly extending flanges of the track for firestopping. These systems include various important disadvantages. Such prior art heat-of wall insulating attempts have required an extensive amount of manual labor at the job site during installation and they are subject to variation in installation techniques which can possibly lead to substandard insulation due to human error installation personnel. Also, when using insulating tape and other similar materials, the metal tracks often require a use of a unique construction on the exterior surface of the metal track. Such unique configurations can include predefined recessed areas or the like which identifies a specific location for the placement of an intumescent and/or acoustic layer of insulation material such as in the form of a tape which, thusly, requires extreme accuracy in placement of the tape of the like. One of the advantages of the apparatus of the present invention is that it is usable with conventionally OEM metal track construction, particularly those used with walls configurations having double studs or larger studs rather than requiring a specially designed metal header track construction. More particularly, the present invention does not require any customized design for the ceiling runner, primarily, because the present construction is designed used without being attached to the track side surfaces sections in any manner whatsoever. Particularly, the present design is very adaptable to applications which allow for some amount relative movement between wall and ceiling components which define the head-of-wall area therebetween during normal expansion and contraction of building materials.

In particular, as the head-of-wall joint moves responsive to normal expansion and contraction of other building components, the insulating tape and/or the coatings of insulating material which are attached directly to the surfaces of the downwardly extending side sections of the ceiling track can become dislodged from components of the head-of-wall area, that is, particularly dislodging from the surfaces of the downwardly extending side sections of the track or runner. The insulation of the present construction is attached only to the outside surface of the top horizontal portion of the track in most applications. In certain other applications, the side pieces can be attached mechanically to the lowermost edge of the downwardly extending side portions of the track. However attachment is never made directly to the outer facing surface of the vertically extending portions of the metal header tracker. Also, prior art configurations do not specifically address the issue of variations in the contour or profile of the ceiling or roof area which comes into direct abutment with the upper portion of the metal track. Such variations in the configuration of the building construction in this area can form gaps between the track and the adjacent roof or ceiling undersurface area which are problematical are not adequately addressed by the insulation configurations of all prior art insulating designs.

2. Description of the Prior Art

Many patents have been granted for various constructions for insulating head-of-wall joints such as shown in U.S. Pat. No. 5,010,702 patented Apr. 30, 1991 to T. L. Daw et al and assigned to Daw Technologies, Inc. on a "Modular Wall System"; and U.S. Pat. No. 5,127,203 patented Jul. 7, 1992 to R. F. Paquette on a "Seismic/Fire Resistant Wall Structure and Method"; and U.S. Pat. No. 5,755,066 patented May 26, 1998 to D. W. Becker on a "Slip Track Assembly; and U.S. Pat. No. 5,913,788 patented Jun. 22, 1999 to T. R. Herren on a "Fire Blocking And Seismic Resistant Wall Structure"; and U.S. Pat. No. 5,921,041 patented Jul. 13, 1999 to J. D. Egri, II on a "Bottom Track For Wall Assembly"; and U.S. Pat. No. 5,950,385 patented Sep. 14, 1999 to T. R. Herren on an "Interior Shaft Wall Construction"; and U.S. Pat. No. 6,058,668 patented May 9, 2000 to T. R. Herren on a "Seismic And Fire-Resistant Head-of-Wall Structure"; and U.S. Pat. No. 6,176,053 patented Jan. 23, 2001 to Roger C. A. St. Germain and assigned to Robert C. A. St. Germain on a "Wall Track Assembly And Method For Installing The Same"; and U.S. Pat. No. 7,043,880 patented May 16, 2006 to M. D. Morgan et al and assigned to W. R. Grace & Co.-Conn. on "In Situ Molded Thermal Barriers"; and U.S. Pat. No. 7,152,385 patented Dec. 26, 2006 to M. D. Morgan et al and assigned to W. R. Grace & Co.-Conn. on "In Situ Molded Thermal Barriers"; and U.S. Pat. No. 7,240,905 patented Jul. 10, 2007 to J. P. Stahl, Sr. and assigned to Specified Technologies, Inc. on a "Method And Apparatus For Sealing A Joint Gap Between Two Independently Movable Structural Substrates"; and U. S. Patent Publication No. 2009/0178363 published Jul. 16, 2009 to D. A. Pilz et al and assigned to California Expanded Metal Products Company on an "Exterior Wall Construction Product"; and U.S. Patent Publication No. 2009/0223159 published Sep. 10, 2009 to Mark Colon on a "Fire Block And Thermal Barrier System For Fluted Metal Decks"; and U.S. Pat. No. 7,617,643 patented Nov. 17, 2009 to D. A. Pilz et al and assigned to California Expanded Metal Products Company on a "Fire-Rated Wall Construction Product"; and U.S. Pat. No. 7,681,365 patented Mar. 23, 2010 to J. A. Klein on "Head-Of-Wall Fireblock Systems And Related Wall Assemblies"; and U.S. Pat. No. 7,752,817 patented Jul. 13, 2010 to D. A. Pilz et al and assigned to California Expanded Metal Products Company on a "Two-Piece Track System"; and U.S. Pat. No. 7,814,718 patented Oct. 19, 2010 to J. A. Klein on "Head-Of-Wall Fireblocks"; and U.S. Pat. No. 7,866,108 patented Jan. 11, 2011 to J. A. Klein on "Head-Of-Wall Fireblock Systems And Related Wall Assemblies"; and U.S. Patent Publication No. 2011/0011019 published Jan. 20, 2011 to James P. Stahl, Jr. et al and assigned to Specified Technologies Inc. on a "Firestopping Sealing Means For Use With Gypsum Wallboard In Head-Of-Wall Construction";

and U.S. Patent Publication No. 2011/0113709 published May 19, 2011 to D. A. Pilz et al and assigned to California Expanded Metal Products Company on a "Wall Gap Fire Block Device, System and Method"; and U.S. Pat. No. 7,950,198 patented May 31, 2011 to D. A. Pilz et al and assigned to California Expanded Metal Products Company on a "Fire-Rated Wall Construction Product"; and U.S. Patent Publication No. 2011/0185656 published Aug. 4, 2011 to J. A. Klein on a "Fire Retardant Cover For Fluted Roof Deck"; and U.S. Patent Publication No. 2011/0214371 published Sep. 8, 2011 on an "Offset Leg Framing Element For Fire Stop Applications" to James A. Klein; and U.S. Patent Publication No. 2011/0247281 published Oct. 13, 2011 to D. A. Pilz et al and assigned to California Expanded Metal Products Company on a "Fire-Rated Wall Construction Product"; and U.S. Pat. No. 8,056,293 patented Nov. 15, 2011 to James A. Klein on "Head-Of-Wall Fireblock Systems And Related Wall Assemblies" and U.S. Pat. No. 8,181,404 patented May 22, 2012 to James Alan Klein on "Head-Of-Wall Fireblocks And Related Wall Assemblies"; and U.S. Pat. No. 8,298,967 patented Oct. 30, 2012 on an "Exterior Finishing System And Building Wall Containing A Corrosion-Resistant Enhanced Thickness Fabric" to William F. Egan et al and assigned to BASF Corporation; and U.S. Pat. No. 8,316,605 patented Nov. 27, 2012 to Craig Oberg on "Insulated Metal Roofing And Wall Systems And Related Methods"; and United States Patent Publication No. 2013/0008104 published Jan. 10, 2013 to Michele Caboni on "Building Construction For Making Transpirable Walls and Floors"; and United States Patent Publication 2013/0034683 published Feb. 7, 2013 to Hans Kramer et al on a "Foam Insulation Unit"; and United States Patent Publication No. 2013/0074432 published Mar. 28, 2013 to Romeo Ilarian Ciuperca on an "Insulated Concrete Form And Method Of Using Same".

SUMMARY OF THE INVENTION

The present invention provides an adjustable head-of-wall insulation construction for sealing a head-of-wall area between a ceiling thereabove and a wall configuration therebelow which is wider than standard and which includes a ceiling track having a main track section which extends generally horizontally and a first track side section extending downwardly therefrom and a second side track section extending downwardly therefrom at a position spatially disposed from the first track section. In this manner the main track section includes a first track side section defining a first lowermost edge thereof and a second side track section defining a second lowermost edge thereof. The construction of the improved insulating gasket construction of the present invention preferably includes a first L-shaped gasket section including a first gasket upper panel of insulating material positioned immediately above the main track section of the ceiling track and extending generally horizontally thereover. The first L-shaped gasket section also includes a first gasket side panel of insulating material attached with respect to the first gasket upper panel and extending generally downwardly therefrom across the first track side section for the purpose of insulating thereadjacent. The first gasket side panel will extend downwardly from the first gasket upper panel to define the generally L-shaped configuration of the first L-shaped gasket section. The first gasket upper panel and the first gasket side panel will in this manner together define a track receiving recess facing downwardly therebelow.

The insulating gasket structure will preferably further include a second L-shaped gasket section including a second gasket upper panel of insulating material positioned immediately above the main track section of the ceiling track and extending generally horizontally thereover at a position spatially disposed from the first gasket upper panel. The second L-shaped gasket section will further include a second gasket side panel of insulating material attached with respect to the second gasket upper panel and extending generally downwardly therefrom across the second track side section for insulating thereover. This second gasket side panel will extend downwardly from the second gasket upper panel in such a manner as to define the generally L-shaped configuration of the second L-shaped gasket section. The second gasket upper panel and the second gasket side panel and the first gasket upper panel and the first gasket side panel together will in this manner define a track receiving recess facing downwardly therebelow for receiving a ceiling track positionable therein for facilitating insulating therearound.

The construction will further include a first panel adhesive means mounted on the first gasket upper panel at a position between the first gasket upper panel of the first L-shaped gasket section and the main track section of the ceiling track to facilitate engagement therebetween. It will also include a second panel adhesive means preferably mounted on the second gasket upper panel at a position between the second gasket upper panel of the second L-shaped gasket section and the main track section of the ceiling track to facilitate engagement therebetween.

Furthermore the construction of the insulating gasket construction of the present invention will further include at least one connecting strap positioned above the main track section of the ceiling track and attached to the first L-shaped gasket section and to the second L-shaped gasket section to limit spatial separation therebetween. Each of the at least one connecting straps will be attached with respect to the first gasket upper panel of the first L-shaped gasket section and also will be attached with respect to the second gasket upper panel of the second L-shaped gasket section. The first and second gasket upper panels will also preferably define slits therein into which the ends of the connecting members can extend to facilitate engagement therewith. In this manner the lateral distances between the first L-shaped gasket sections and the second L-shaped gasket sections can be varied by choosing connecting straps of various lengths. Such connecting straps will preferably be made of plastic but can be made of any material. The connecting straps can be securement mechanisms of the ends of the connecting straps can include securement ears and securement projections to facilitate engagement with respect to the respective slits defined in the first and second L-shaped gasket sections.

It is an object of the construction for insulating head-of-wall joints of the present invention to be usable with floor or roof constructions of any conventional construction including solid concrete or a composite material installed atop a corrugated steel deck.

It is an object of the construction for insulating head-of-wall joints of the present invention to prevent the spread of sound, noise, fire, super-heated gases, flames and/or smoke in these areas.

It is an object of the construction for acoustical and/or thermal insulating head-of-wall joints of the present invention to provide more effective insulating by providing attachment of the insulating material to the metal track only in the central upper portion thereof or at the lowermost edges of the track side walls without any attachment whatsoever to the surfaces of the downwardly extending track side sections to facilitate insulating therearound irrespective of the normal expansion and contraction of building structural components that take place over the time period prior to the occurrence of the fire conditions.

It is an object of the construction for insulating head-of-wall joints of the present invention to effectively seal between conventionally designed metal track sections and the immediately adjacent roof or ceiling area for firestopping and/or acoustic insulating thereof which is particularly usable with double stud wall constructions or constructions using studs having greater than normal lateral dimensions wherein the firestopping means is adjustably variable in lateral dimension to accommodate same.

It is an object of the construction for insulating head-of-wall joints of the present invention to be usable with conventional steel framing and gypsum board wall constructions and particularly usable with double steel stud framing wall constructions.

It is an object of the construction for insulating head-of-wall joints of the present invention to minimize costs and maintenance requirements.

It is an object of the construction for insulating head-of-wall joints of the present invention to expedite installation and minimize labor costs.

BRIEF DESCRIPTION OF THE DRAWINGS

While the invention is particularly pointed out and distinctly described herein, a preferred embodiment is set forth in the following detailed description which may be best understood when read in connection with the accompanying drawings, in which.

DETAILED DESCRIPTION OF THE PREFERRED EMBODIMENT

Figure 1A:
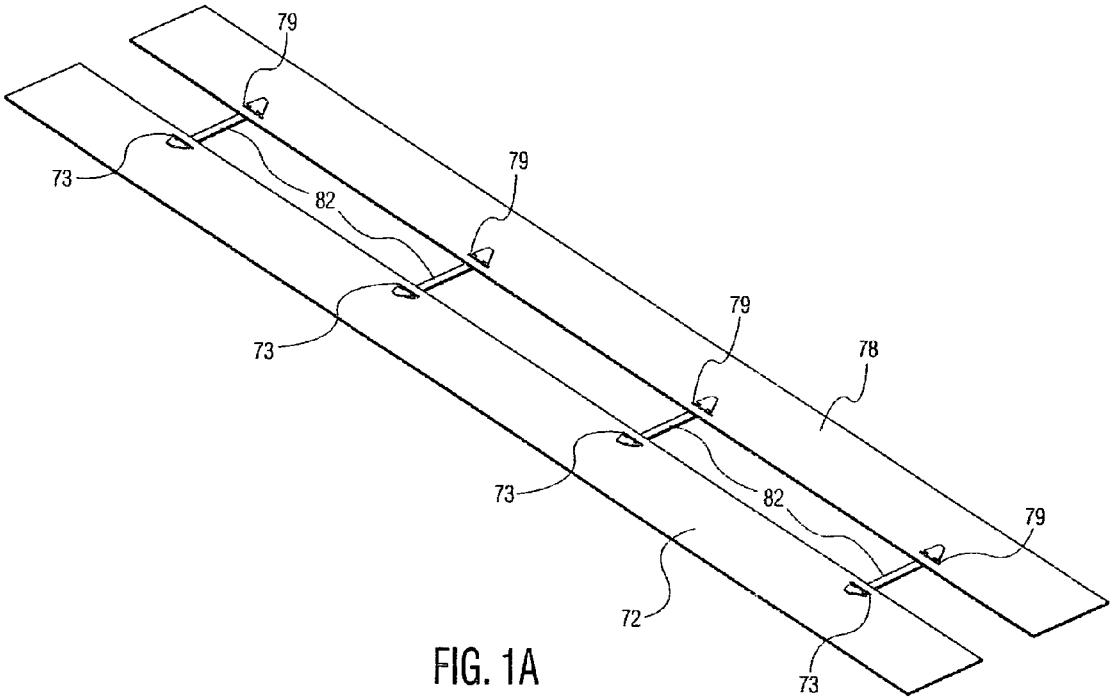
FIG. 1A is an isometric top perspective view of an embodiment of the present invention showing the first and second gasket upper panel spatially disposed apart and attached together with connecting straps to allow positioning of the first and second L-shaped gasket sections to be position insulating walls having larger than conventional lateral dimensions.
Figure 1B:
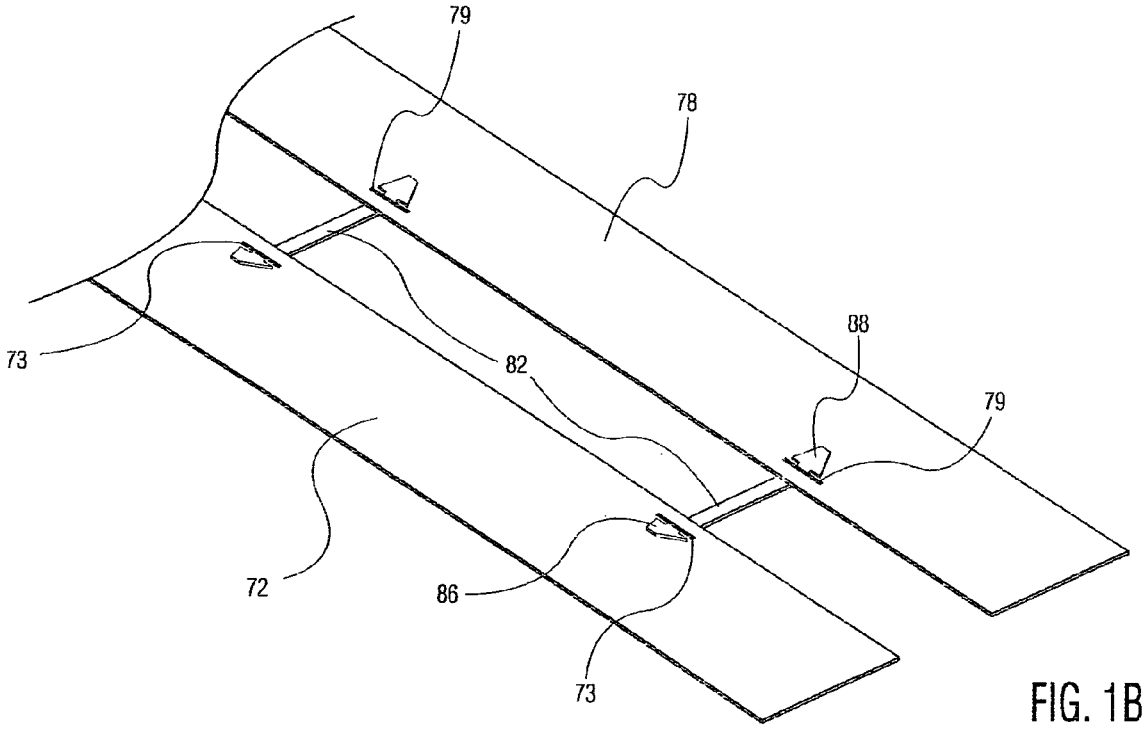
FIG. 1B is an exploded view of the lower portion of FIG. 1A to show in more detail the connecting straps positioned extending through the first and second uppers slits for attaching the first and second L-shaped gaskets sections together.
Figure 2A:
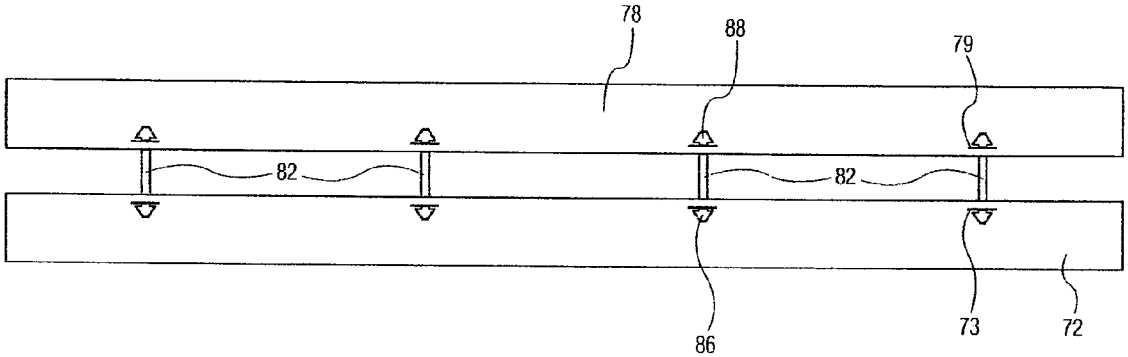
FIG. 2A is a top plan view of the embodiment of the present invention shown in FIG. 1A.
Figure 2B:
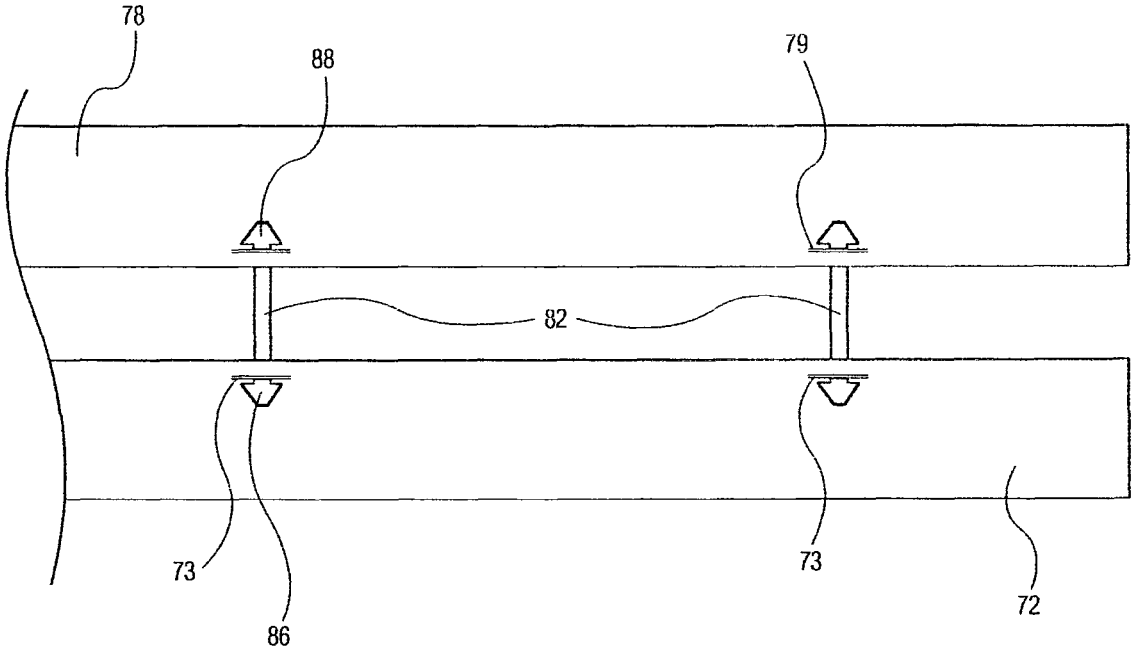
FIG. 2B is an exploded view of the lower portion of FIG. 2A to show in more detail the connecting straps positioned extending through the first and second uppers slits for attaching the first and second L-shaped gaskets sections together.
Figure 3:
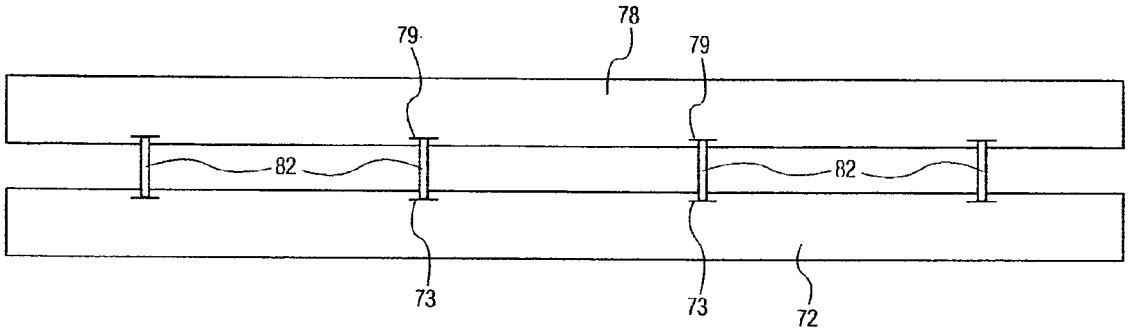
FIG. 3 is bottom plan view of the embodiment of the present invention shown in FIG. 1A and FIG. 1B.
Figure 4:
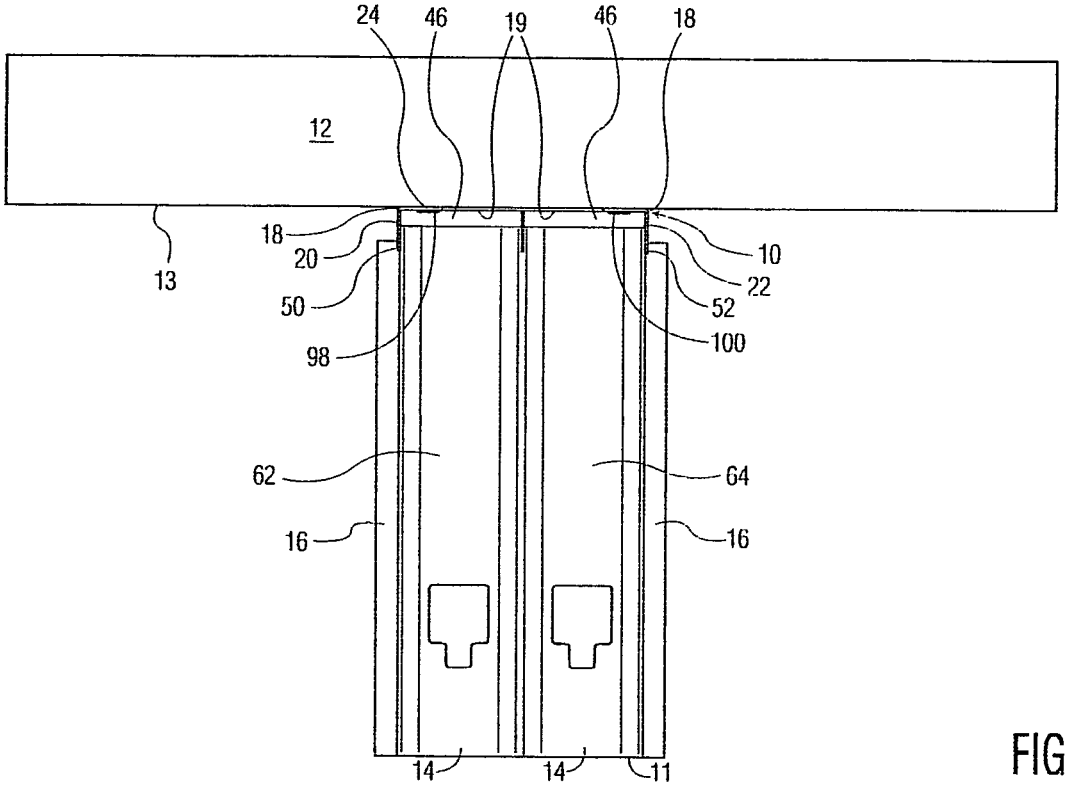
FIG. 4 is a cross-sectional side plan view of an embodiment of the insulating gasket of the present invention shown positioned in a head wall area between a ceiling and wall construction therebelow clearly showing the L-shape configuration of each of the first and second L-shaped gasket sections.
Figure 5:
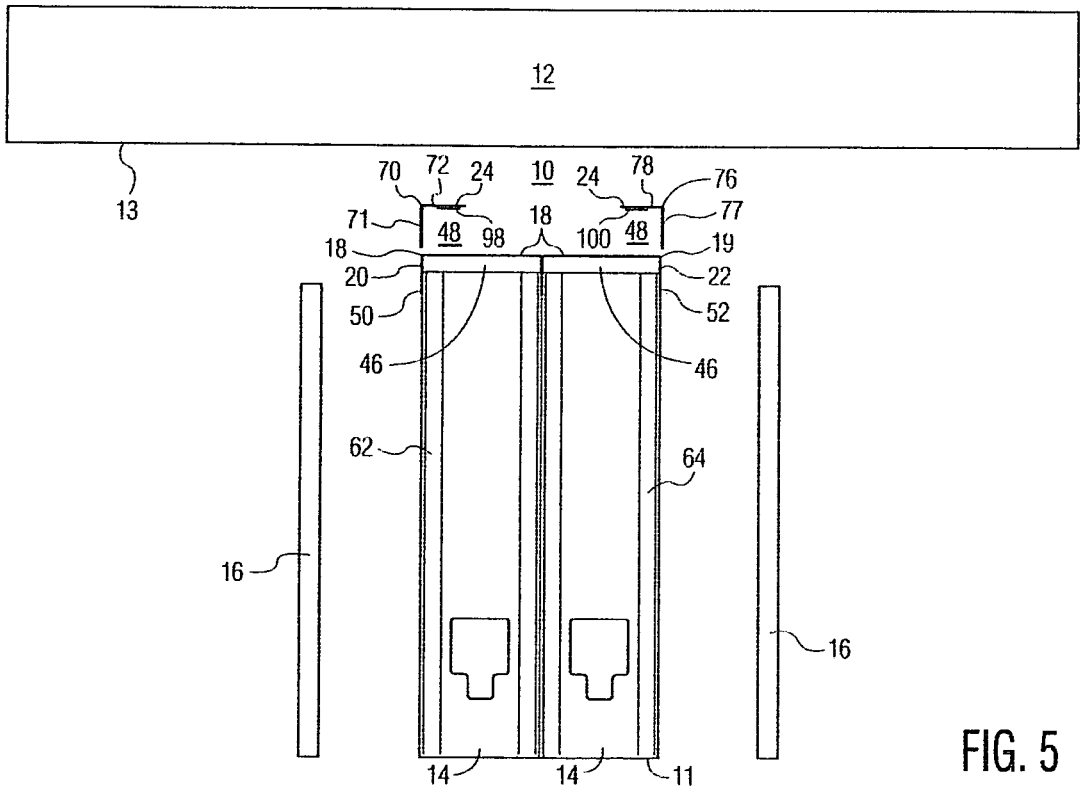
FIG. 5 is an exploded assembly view of the embodiment shown in FIG. 4.
Figure 6:
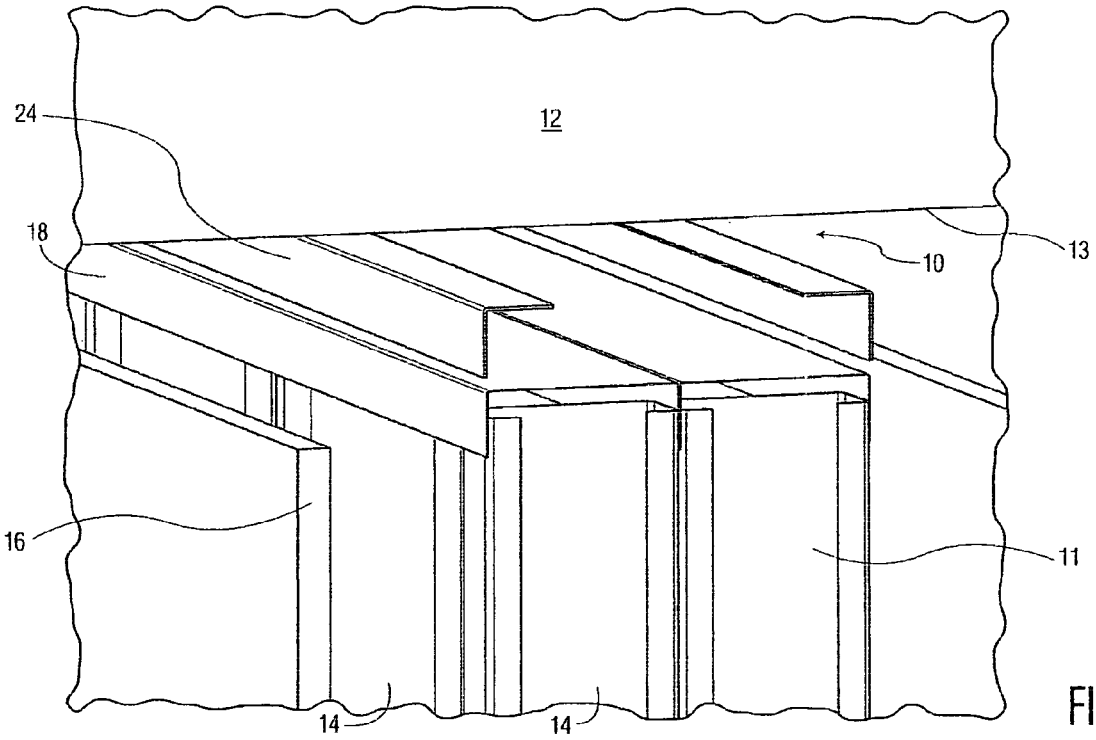
FIG. 6 is an perspective view from below of the head-of-wall area with an embodiment of the two L-shaped gaskets shown in place therewithin.

The present invention discloses a unique configuration for an insulating gasket 24 usable positioned adjacent to the head-of-wall joint 10 of a conventional building construction for insulating sealing thereof, primarily for firestopping but can include acoustically insulating characteristics also. The construction of insulating gasket 24 is designed for use with any larger than conventional building wall configuration 11 such as those walls that make use of enlarged sized studs or has a multiple stud construction such as double studded walls. For this purpose the head-of-wall gasket of the present invention is laterally adjustable to seal in head-of-wall areas formed above double stud walls or wall constructed with studs having larger than normal lateral dimensions. If configured for firestopping, the insulating gasket 24 which will include a firestopping material which may include an intumescent component therein. If configured for acoustic insulating the insulating gasket 24 will include an acoustically insulating material component therewithin. Gasket 24 can include either firestopping or acoustic insulation, or both, depending on the specific requirements of a given application. For either of these insulating purposes, the insulating gasket 24 will be positioned between the bottom 13 of an upper building structure 12, such as a floor or roof, and a wall assembly or configuration 11 therebelow which may be fire-rated or may have a need for acoustical insulation thereabove. Such wall configurations 11 often include steel framing members or studs 14 mounted in such a manner as to defined two walls laterally immediately adjacent one another with gypsum board 16 mounted thereupon and extending vertically therewith.

A ceiling track or runner 18 is secured to the bottom area 13 of the upper building structure floor or roof 12, conventionally, such that it is adapted to receive the framing members 14 positioned retained therewithin. The ceiling track 18 preferably includes a main track section 19 which normally extends approximately horizontally and a first track side section 20 extending approximately vertically downwardly therefrom and a second track side section 22 extending approximately vertically downward therefrom at a position spatially disposed from the first track side section 20. In this manner a framing receiving area 46 will be defined between the first track side section 20 and the second track side section 22 into which the upper portion of the steel framing studs 14 preferably extends.

The insulating gasket 24 of the present invention will preferably be formed as a paper-type product having significant flexibility and will include at least one component which provides the intumescent firestopping insulation or, if acoustic, will, preferably, include a felt material to minimize sound transmissions therethrough. With either construction the insulating material will be particularly flexible. However, in the present invention, enhanced strength or reinforcement of the material can, optionally, be provided by including a reinforcing facing member on one side of the insulating gasket member 24 of polyethylene material or other similar material. For example, an inner facing reinforcing member can be positioned extending over the gasket insulating section facing the ceiling track 18. However, it is preferable to provide an outer facing reinforcing member which comprises a layer extending over the surface of the gasket insulating section facing outwardly away from the ceiling track 18. It should be appreciated that although this reinforcing facing member can be applied on the outwardly facing portion of the insulating gasket member 24 or the inwardly facing portion thereof, preferably, it is positioned on the outwardly facing surface, particularly when aesthetic considerations are of a concern.

The shape of the insulating gasket construction 24 is preferably L-shaped and when used in pairs on a given wall 11 will define an overall downwardly facing C-shaped construction similar to the overall shape of the ceiling track or runner 18. With the total head-of-wall insulation provided by two L-shaped members, each will be positioned extending along each laterally and oppositely facing upper longitudinally extending upper edge of a wall construction. In this manner these two similarly shaped L-shaped members will co-operate together to define a downwardly facing C-shaped configuration for the insulating material similar to the shape and orientation of ceiling track 18. These two sections are defined as the first L-shaped gasket section 70 and the second L-shaped gasket section 76.

Each first L-shaped gasket section 70 will include a first gasket upper panel 72 extending over one side of the main track section 19 of ceiling track 18. Each first L-shaped gasket section 70 will also include a first gasket side panel 71 attached to the first gasket upper panel 72 and extending outwardly over the first track side section 20 of ceiling track 18.

Similarly, each second L-shaped gasket section 76 will include a second gasket upper panel 78 extending over one side of the main track section 19 of ceiling track 18 at a position spatially disposed from the first gasket upper panel 72. Each second L-shaped gasket section 76 will also include a second gasket side panel 77 attached to the second gasket upper panel 78 and extending outwardly over the second track side section 22 of ceiling track 18.

Usually the first and second gasket side panels 71 and 77 will be spaced apart from one another to define therebetween the track receiving recess 48 for receiving of a ceiling track 18 of a similar complementary shape for positioned therewithin. With this configuration the first gasket upper panel 72 and the second gasket upper panel 78 of the two L-shaped sections 70 and 76 will extend generally horizontally at a position immediately above the main track section 19 of ceiling track 18. It is preferably that the first L-shaped gasket section 70 and the second L-shaped gasket section 76 be connected to each other in some manner. For this purpose the construction of the insulating gasket of the present invention will, preferably, include one or more connecting straps 82 which can be of any material, but are preferably made of plastic. The first gasket side panel 71 will extend generally vertically downwardly at a position immediately adjacent to and extending over the first track side section 20 to form the shape of first L-shaped gasket section 70. Similarly, the second gasket side panel 77 will extend generally vertically downwardly at a position extending adjacent to and over the outwardly facing surface of the second track section 22 to form the shape of the L-shaped second gasket section 76. In this manner a structural mating is provided between the configuration of the insulating gasket construction 24 and the ceiling track 18.

To facilitate positioning of the ceiling track 18 within track receiving recess 48 of the U-shaped insulating gasket 24, the insulating gasket 24 will preferably be constructed with the first side gasket section 71 and the second side gasket section 77 outwardly splayed slightly from the main gasket section 71. That is, first gasket side panel 71 will preferably extend vertically downwardly and outwardly from the main gasket section at an outwardly splayed obtuse. Similarly the section gasket side panel 77 will extend generally vertically downwardly and outwardly from the main gasket section with an obtuse outwardly splayed angle therebetween. In this manner, the shape of track receiving recess 48 of the insulating gasket 24 will have an outwardly splayed shape for facilitating receiving of the ceiling track 18 thereinto. Thus, it will much easier for installation persons to position of the insulating gasket 24 in surrounding engagement with respect to the ceiling track 18 with the main track section 19, the first side track section 20 and the second track side section 22 easily able to be positioned within track receiving recess 48.

It should be appreciated that one of the advantages of the construction of the present invention is that the outwardly splaying of first gasket side panel 71 relative to the main gasket section will inherently define a gap between the first gasket side panel 71 and the first track side section 20 located thereadjacent. Similarly, the outwardly splaying of second gasket side panel 77 relative to the main gasket section will inherently also define a gap between the second gasket side panel 77 and the second track side section 22 located thereadjacent. This added spacing created these gaps between the insulating gasket member 24 and the first gasket side panel 20 and the second gasket side panel 22, respectively, has been found to greatly enhance the firestopping and acoustical insulating characteristics thereof while also facilitating installation.

In most prior art constructions the ceiling tracks or runners 18 are attached directly to the bottom 13 of the upper building floor or roof structure 12 by the use of fasteners such as staples, nails, screws or other penetrating fastening members usually made of steel. It is important consideration of the present invention to appreciate that when an insulating gasket 24 is positioned in surrounding relationship with respect to a ceiling track or runner 18 prior to affixing of the track 18 to the bottom 13 of the upper building structure 12, then attachment to the upper building structure 12 thereof is performed in the conventional manner by placement of such penetrating fasteners in engagement with and usually extending between the upper panels of the two L-shaped gasket sections simultaneously with placing thereof through the ceiling track 18 which facilitates attachment to be made without requiring any additional labor expense of time and/or effort.

Normally fasteners penetrate through the main track section 19 of a ceiling track 18 for securement of the ceiling track 18 to the bottom 13 of the upper building structure 12. The conventional labor process for making this attachment will, thusly, also urge the insulating gasket 24 toward the proper position without requiring any additional labor effort.

Each of the upper panels 72 and 78 of the first and second L-shaped gasket sections may also include an adhesive means attached to the bottom of the respective uppers panels thereof to facilitate securement to the upper surface of the track. First gasket upper panel 72 can receive a first upper panel adhesive means 98 attached to the undersurface thereof to facilitate direct engagement to the main track section 19 of ceiling track 18. Similarly, second gasket upper panel 78 can receive a second upper panel adhesive means 100 attached to the undersurface thereof to facilitate direct engagement to the main track section 19 of ceiling track 18 at a position adjacent to the first gasket upper panel 72. It is also very important to consider that this absence of attachment will allow both the first gasket side panel 71 and the second gasket side panel 77 to move freely over the outer surfaces of the downwardly extending first track side section 20 and second track side section 22 responsive to relative movement between the upper building structure 12 and the wall configuration 11. This absence of any direct attachment between first track side section 20 and first gasket side panel 71 as well as the lack of direct attachment between the second track side section 22 and the second gasket side panel 77 allows this freedom of movement to respond to relative structural movement while still maintaining the gasket side panels 71 and 77 at positions adjacent the respective track side section 20 and 22 while maintaining positioning of the gasket side panels 71 and 77 extending generally thereover to facilitate insulation thereadjacent.

Commonly such head-of-wall structures include an open area immediately above the track 18. These areas are often insulated by a conventional means such as firestopping pillows which are usually primarily of mineral wool material or by manual application of mastic materials. It should be particularly appreciated that the insulating gasket 24 can include any one of a wide variety of different insulating materials. The preferential insulating component for this gasket member 24 for firestopping would be an intumescent material. However, many other insulating materials would be effective for firestopping depending somewhat upon the construction and materials with which the apparatus of the present invention is used.

Furthermore, the insulating gasket construction 24 of the present invention, can be made with an acoustic insulating version which includes a component which may or may not also include a firestopping component. For example, another different insulating material that could be used would be felt-type material that could be similarly strengthened by a reinforcing facing member preferably positioned as an outer reinforcing facing member preferably of a polyethylene material. The use of felt material in the gasket insulation section of the insulating gasket 24 would be advantageous because it would provide unique acoustic properties that would enhance the acoustic insulating characteristics of the gasket of the present invention. Because of the lack of structural strength in such felt material, use of this material may require the inclusion of an outer reinforcing member to fully strengthen the gasket insulation section.

An additional means of achieving flexible securement between the insulation gasket construction 24 and the ceiling track 18 could be by including attachment tabs 42 defined formed in the first and second gasket side panels 71 and 77. Such tabs 42 could be formed by making side perforations 40 along each of the gasket side panels 71 and 77. The preferred construction for providing these attachment tabs 42 is by making a semi-circular cut lines 44 extending completely through side panels 71 and 77, preferably, using a semicircular-shaped punch which is arcuate in the upper portion and is generally C-shaped and faces downwardly toward the first lower edge 29 of first gasket side panel 71 and toward the second lower edge 31 of second gasket side panel 77 in order to form the attachment tabs 42 facing upwardly and extending inwardly therefrom. Preferably, the location of each of these punched sections will form an attachment tab 42 of the gasket material centrally located within the C-shaped punch pattern which will be spaced upwardly from the first lower edge 29 of first gasket side panel 71 and will be spaced upwardly from the second lower edge 31 of the second gasket side panel 77. Each of the first tabs 60 and the second tabs 61 will extend generally inwardly from the first gasket side panel 71 and second gasket side panel 77 into the frame receiving area 46. In this manner the first gasket side panel 71 will extend around and be attached with respect to the first lowermost edge 50 of the first track side section and the second gasket side panel 77 will extend around and be attached to the second lowermost edge 52 of second track side section 22. The attachment tabs 42 defined in the first gasket side panel 71 are referenced herein as the first tabs 60. The attachment tabs 42 defined in the second gasket side panel 77 are referenced herein as the second tabs 60. Tabs 60 will extend downwardly beneath the first lowermost edge 50 of first track side section 20. Tabs 61 will extend downwardly beneath the second lowermost edge 52 of second track side section 22. Neither of the track side sections 20 and 22 will be otherwise secured with respect to the vertically extending surface of either of the track side sections 20 and 22. Thus, effective positioning of the first and second gasket side panels 71 and 77 can be achieved without requiring any expansive securement thereof with respect to the surfaces of the main track side sections 20 and 22 to facilitate maintaining of insulation of the head-of-wall area when relative movement has occurred between the wall structure 11 and the upper build floor or roof 12. That is, the securement will be to the first and second lowermost edges 50 and 52 of the track side sections 20 and 22, respectively, rather than onto any portion of the expansive surfaces of the side portions thereof.

Preferably there will be a plurality of such first attachment tabs 60 positioned along the longitudinally extending length of the first gasket side panel 71 and a plurality of such second attachment tabs 61 positioned along the longitudinally extending length of the second gasket side panels 77 to achieve effective attachment thereto.

The construction of the head-of-wall insulating gasket of the present invention is particularly usable with thicker wall constructions such as those having double stud configurations which include a plurality of first stud members 62 and a plurality of second stud members 64 positioned back to back in a wall construction. Such wider wall constructions can be easily accommodated because variations the lateral spacing between the first L-shaped gasket section 70 and the second L-shaped gasket section 76 can be made to account for wall thickness variations. Such variations in the spacing between sections 70 and 76 can more accurately and reliably be controlled by making available various different lengths of connecting straps 82 which connect therebetween to maintain positioning thereof relative to the wall configuration 11.

Preferably, the first gasket upper panel 72 of first L-shaped gasket section 70 will define therein at least one first upper slit 73 to facilitate attachment thereof with respect to an adjacent connecting strap 82. Second gasket upper panel 78 of second L-shaped gasket section 76 will define therein at least one second upper slit 79 to facilitate attachment thereof with respect to an adjacent connecting strap. Connecting strap 82 will include a first strap securement means 86 thereon to facilitate securement with respect to the first upper slit or slits 73 defined in the first gasket upper panel 78. Connecting strap 82 will also include a second strap securement means 86 thereon to facilitate securement with respect to the second upper slit or slits 73 defined in the second gasket upper panel 78. In this manner engagement of the first strap securement means 86 with respect to the first upper slit 73 and engagement of the second strap securement means 88 with respect to the second upper slit 79 will secure the connected strap 82 to both the first L-shaped gasket section 70 and to the second L-shaped gasket section 76 and, thusly, secure them together also.

First strap securement means 86 will, preferably, include a first securement projection 90 adapted to extend into and through the first upper slits 73 to further facilitate operative engagement therewith. First securement protection 90 will, preferably, include first securement ears 92 extending outwardly therefrom which are positionable at a position extending through the first upper slots 73 to extend out laterally thereadjacent with respect thereto to further facilitate engagement between a connecting strap 82 and the first L-shaped gasket section 70.

Similarly, second strap securement means 88 will, preferably, include a second securement projection 94 adapted to extend into and through the second upper slits 79 to further facilitate operative engagement therewith. Second securement protection 94 will, preferably, include second securement ears 96 extending outwardly therefrom which are positionable at a position extending through the second upper slots 79 to extend out laterally thereadjacent with respect thereto to further facilitate engagement between a connecting strap 82 and the second L-shaped gasket section 76.

In this manner, the first L-shaped gasket section 70 and the second L-shaped gasket section 76 will be attached by one or more connecting straps 82 to define the maximum distance of spacing therebetween when attached to the upper surface of main track section 19 of ceiling track 18. Each connecting strap 82 can be of any material but, preferably, is of a thermoplastic material.

Individual connecting straps 82 can be of various predetermined lengths in order to accommodate various lateral dimensions between the required position of the first gasket side panel 71 and the second gasket side panel 77. This lateral dimension between those two parts is variable responsive to the thickness of wall configuration 11. In this manner, the two L-shaped insulating gasket sections 70 and 76 can be spaced apart at any desired dimension by choosing an appropriate longitudinal length for the connecting straps 82 interconnecting the first upper slits 73 with respect to the second upper slits 79 when in engagement therewith. This construction for a head-of-wall insulation construction provides a very versatile system which can accommodate various different sizes of walls in head-of-wall areas and is usable in a universal manner without requiring different sizes of the gasket itself since the variation and size is achieved solely by providing connecting straps 82 of lengths readily available at the time of installation.

Figure 7:
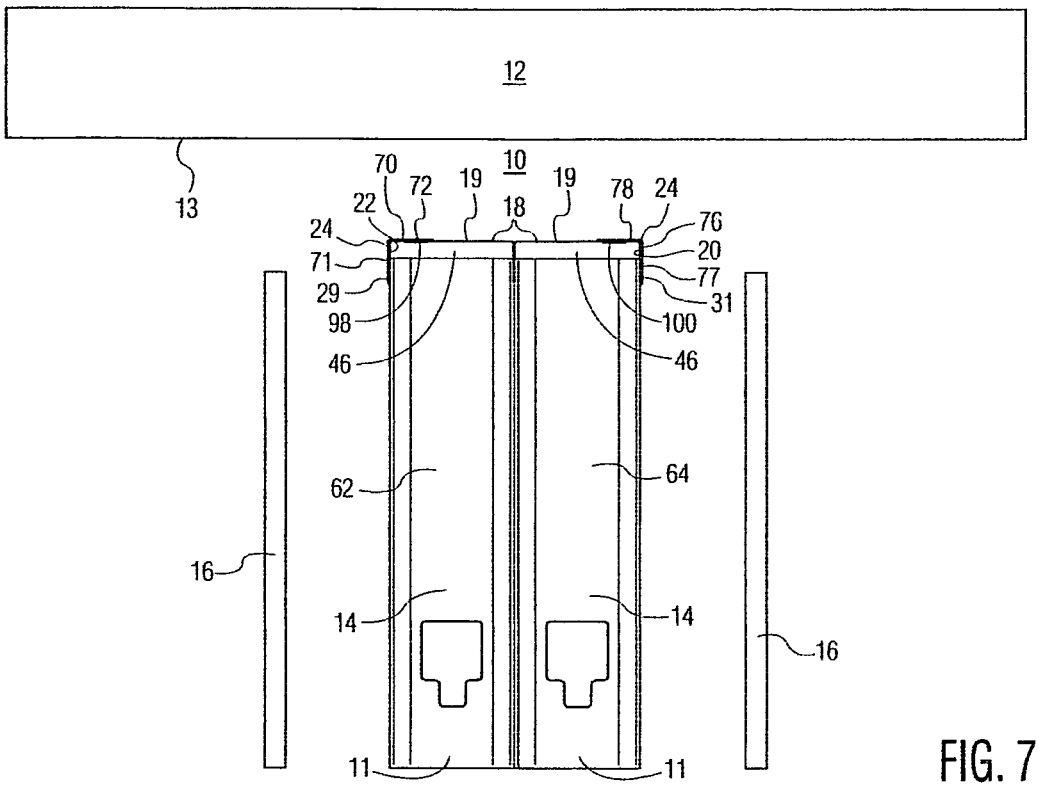
FIG. 7 is a schematic side cross-sectional view of the two L-shaped gasket sections of an embodiment of the insulating gasket construction of the present invention shown connected together and in position above and extending around a double studded wall configuration within a head-of-wall area.
Figure 8:
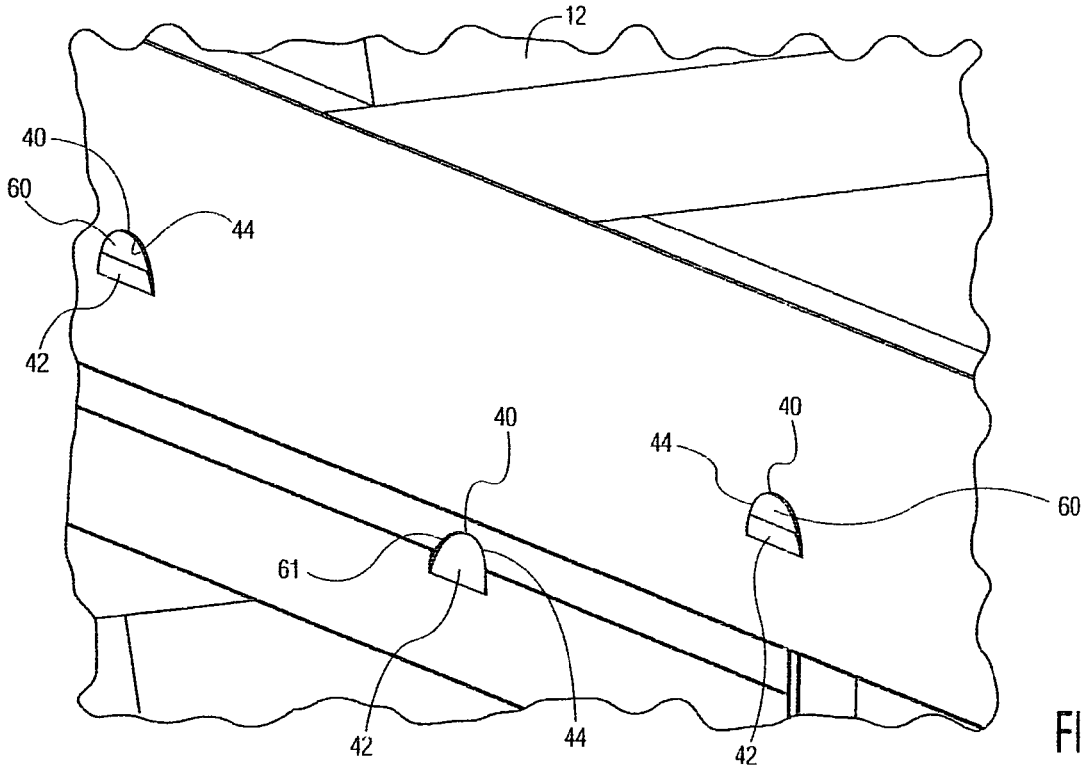
FIG. 8 is a perspective view an embodiment of the insulating gasket construction of present invention shown from beneath to illustrate individual attachment tabs formed by side cut perforations in the first and second gasket side panels.
Figure 9:
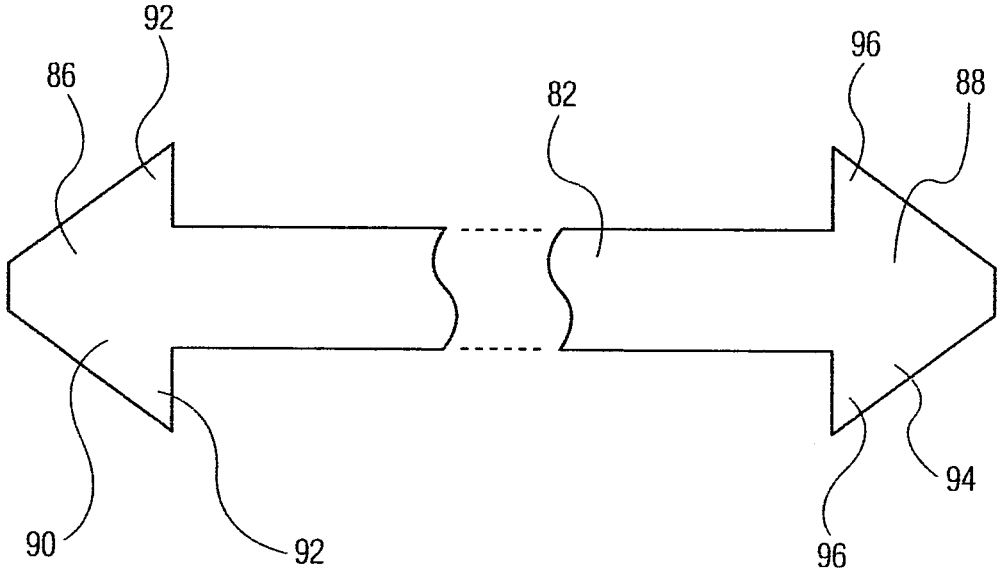
FIG. 9 is a top plan view of an embodiment of a connecting strap showing the details of the construction of the first and second protection and ears on each end thereof.

It should be appreciated that the present invention is particularly usable in double wall constructions such as shown in cross-section in FIG. 7. Such wall constructions are often formed with two immediately adjacent wall studding constructions and, hence, include two immediately adjacent ceiling tracks 18 which are C-shaped and both face downwardly to receive each of the two adjacently positioned stud wall constructions. Thus, each of the two adjacent downwardly facing ceiling tracks 18 includes first and second track side section 20 and 22 extending downwardly from each of two main track sections 19 of each ceiling track 18. It must be understood that only the outermost side areas of any head-of-wall joint 10 needs be insulated. Therefore, positioning two or more wall thicknesses adjacent to one another does not change the insulation requirements at the outer edge of the side areas thereof. Even when the lateral spacing between the insulation panels is increased, the components of the insulation gasket construction remains basically the same except for the spacing therebetween. Only the position of the lateral outermost sides of the wall construction will be spaced apart at a greater distance in a double or triple wall construction that in a single stud construction wall configuration. Regardless of the increased lateral size of the wall construction with which the insulating gasket construction of the present application is being utilized, there is only one outermost area on each side that needs to be insulated. Thus, the thickness of the particular wall construction or the number of stud constructions in a wall construction with which the present invention is used does not change the requirement that a single first track side section 20 is defined on one side of the ceiling track adjacent the head-of wall area above a wall construction and a single second track side section defined and spaced therefrom on the opposite side of the head-of wall area above a wall construction and that each of these areas needs to be insulated in order to insulation the head-of wall area. Also, two or more main track sections 20 may be included positioned adjacent to one another to define the uppermost horizontally extending portion of the ceiling track 18 but only the outermost portions thereof need to be insulated to achieve effective insulation of the head-of wall area thereabove. Thus, the construction of the insulating gasket construction 24 of the present invention is structural identical regardless of the wall thickness except for the lateral spacing therebetween.

While particular embodiments of this invention have been shown in the drawings and described above, it will be apparent that many changes may be made in the form, arrangement and positioning of the various elements of the combination. In consideration thereof, it should be understood that preferred embodiments of this invention disclosed herein are intended to be illustrative only and not intended to limit the scope of the invention.

I claim:

1. An adjustable head-of-wall insulating construction for sealing a head-of-wall area between a ceiling thereabove and a wall configuration therebelow which is wider than standard and which includes a ceiling track having a main track section which extends generally horizontally and a first track side section extending downwardly therefrom and a second side track section extend downwardly therefrom at a position spatially disposed from the first track section wherein the main track section includes a first track side section defining a first lowermost edge thereof and a second side track section defining a second lowermost edge thereof, said insulating gasket construction comprising:

A. an L-shaped gasket section including:

(1) a gasket upper panel of insulating material positioned immediately above the main track section of the ceiling track and extending generally horizontally thereover; and (2) a gasket side panel of insulating material attached with respect to said gasket upper panel and extending generally downwardly therefrom across the first track side section for insulating thereover, said gasket side panel extending downwardly from said gasket upper panel to define the generally L-shape configuration of the L-shaped gasket section, said gasket upper panel and said gasket side panel together defining a track receiving recess facing downwardly therebelow; and B. a panel adhesive means mounted on said gasket upper panel at a position between said gasket upper panel and the main track section at a position immediately therebelow to facilitate engagement between said gasket upper panel of said L-shaped gasket section and the main track section of the ceiling track;

wherein the first track side section includes a first lower edge therealong and wherein said gasket side panel includes at least one attachment side tab extending inwardly into said track receiving recess at a position beneath the first track side section for engagement therewith to facilitate retaining of said L-shaped gasket section adjacent the main track section.

2. An adjustable head-of-wall insulating construction for sealing a head-of-wall area as defined in claim 1 wherein said gasket side panel is spatially disposed from the first track side section to be moveable with respect thereto responsive to relative movement between the wall configuration and the upper building structure thereabove.

3. An adjustable head-of-wall insulating construction for sealing a head-of-wall area as defined in claim 1 wherein said gasket upper panel and said gasket side panel are made from an insulating material which includes a firestopping insulating component therewithin.

4. An adjustable head-of-wall insulating construction for sealing a head-of-wall area as defined in claim 3 wherein the firestopping insulating component is intumescent.

5. An adjustable head-of-wall insulating construction for sealing a head-of-wall area as defined in claim 1 wherein said gasket upper panel and said gasket side panel are made from an insulating material which includes an acoustical insulating component therewithin.

6. An adjustable head-of-wall insulating construction for sealing a head-of-wall area between a ceiling thereabove and a wall configuration therebelow which is wider than standard and which includes a ceiling track having a main track section which extends generally horizontally and a first track side section extending downwardly therefrom and a second side track section extend downwardly therefrom at a position spatially disposed from the first track section wherein the main track section includes a first track side section defining a first lowermost edge thereof and a second side track section defining a second lowermost edge thereof, said insulating gasket construction comprising:

A. a first L-shaped gasket section including:

(1) a first gasket upper panel of insulating material positioned immediately above the main track section of the ceiling track and extending generally horizontally thereover; and (2) a first gasket side panel of insulating material attached with respect to said first gasket upper panel and extending generally downwardly therefrom across the first track side section for insulating thereover, said first gasket side panel extending downwardly from said first gasket upper panel to define the generally L-shaped configuration of the first L-shaped gasket section, said first gasket upper panel and said first gasket side panel together defining a track receiving recess facing downwardly therebelow;

B. a second L-shaped gasket section including:

(1) a second gasket upper panel of insulating material positioned immediately above the main track section of the ceiling track and extending generally horizontally thereover at a position spatially disposed from said first gasket upper panel; and (2) a second gasket side panel of insulating material attached with respect to said second gasket upper panel and extending generally downwardly therefrom across the second track side section for insulating thereover, said second gasket side panel extending downwardly from said second gasket upper panel to define the generally L-shaped configuration of the second L-shaped gasket section, said second gasket upper panel and said second gasket side panel and said first gasket upper panel and said first gasket side panel together defining a track receiving recess facing downward therebelow for receiving a ceiling track positionable therewithin for facilitating insulating therearound;

C. a first panel adhesive means mounted on said first gasket upper panel at a position between said first gasket upper panel of said first L-shaped gasket section and the main track section of the ceiling track to facilitate engagement therebetween;

D. a second panel adhesive means mounted on said second gasket upper panel at a position between said second gasket upper panel of said second L-shaped gasket section and the main track section of the ceiling track to facilitate engagement therebetween; and E. at least one connecting strap positioned above the main track section of the ceiling track and attached to said first L-shaped gasket section and to said second L-shaped gasket section to limit spatial separation therebetween.

7. An adjustable head-of-wall insulating construction for sealing a head-of-wall area as defined in claim 6 wherein said at least one connecting strap is attached with respect to said first gasket upper panel of said first L-shaped gasket section and is also attached with respect to said second gasket upper panel of said second L-shaped gasket section.

8. An adjustable head-of-wall insulating construction for sealing a head-of-wall area as defined in claim 6 wherein said first gasket side panel is spatially disposed from the first track side section to be moveable with respect thereto responsive to relative movement between the wall configuration and the upper building structure thereabove and wherein said second gasket side panel is spatially disposed from the second track side section to be moveable with respect thereto responsive to relative movement between the wall configuration and the upper building structure thereabove.

9. An adjustable head-of-wall insulating construction for sealing a head-of-wall area as defined in claim 6 wherein said first gasket upper panel and said first gasket side panel are made from an insulating material which includes a firestopping insulating component therewithin.

10. An adjustable head-of-wall insulating construction for sealing a head-of-wall area as defined in claim 9 wherein the firestopping insulating component is intumescent.

11. An adjustable head-of-wall insulating construction for sealing a head-of-wall area as defined in claim 6 wherein said first gasket upper panel and said first gasket side panel are made from an insulating material which includes an acoustical insulating component therewithin.

12. An adjustable head-of-wall insulating construction for sealing a head-of-wall area as defined in claim 6 wherein said first gasket upper panel is integrally formed with respect to said first gasket side panel and wherein said second gasket upper panel is integrally formed with respect to said second gasket side panel.

13. An adjustable head-of-wall insulating construction for sealing a head-of-wall area between a ceiling thereabove and a wall configuration therebelow which is wider than standard and which includes a ceiling track having a main track section which extends generally horizontally and a first track side section extending downwardly therefrom and a second side track section extend downwardly therefrom at a position spatially disposed from the first track section wherein the main track section includes a first track side section defining a first lowermost edge thereof and a second side track section defining a second lowermost edge thereof, said insulating gasket construction comprising:

A. a first L-shaped gasket section including:

(1) a first gasket upper panel of insulating material positioned immediately above the main track section of the ceiling track and extending generally horizontally thereover; and (2) a first gasket side panel of insulating material attached with respect to said first gasket upper panel and extending generally downwardly therefrom across the first track side section for insulating thereover, said first gasket side panel extending downwardly from said first gasket upper panel to define the generally L-shaped configuration of the first L-shaped gasket section, said first gasket upper panel and said first gasket side panel together defining a track receiving recess facing downwardly therebelow;

B. a second L-shaped gasket section including:

(1) a second gasket upper panel of insulating material positioned immediately above the main track section of the ceiling track and extending generally horizontally thereover at a position spatially disposed from said first gasket upper panel; and (2) a second gasket side panel of insulating material attached with respect to said second gasket upper panel and extending generally downwardly therefrom across the second track side section for insulating thereover, said second gasket side panel extending downwardly from said second gasket upper panel to define the generally L-shaped configuration of the second L-shaped gasket section, said second gasket upper panel and said second gasket side panel and said first gasket upper panel and said first gasket side panel together defining a track receiving recess facing downward therebelow for receiving a ceiling track positionable therewithin for facilitating insulating therearound;

C. a first panel adhesive means mounted on said first gasket upper panel at a position between said first gasket upper panel of said first L-shaped gasket section and the main track section of the ceiling track to facilitate engagement therebetween; and D. a second panel adhesive means mounted on said second gasket upper panel at a position between said second gasket upper panel of said second L-shaped gasket section and the main track section of the ceiling track to facilitate engagement therebetween;

wherein said first gasket upper panel defines at least one first upper slit therein and wherein said second gasket upper panel defines at least one second upper slit therein, said and at least one connecting strap extending into said at least one of said first upper slits and also extending into said at least one of said second upper slits to attached said first L-shaped gasket with respect to said second L-shaped gasket to limit spatial separation therebetween.

14. An adjustable head-of-wall insulating construction for sealing a head-of-wall area as defined in claim 13 wherein each of said at least one connecting straps includes a first strap securement means attachable with respect to said first upper slits and wherein each of said at least one connecting straps includes a second strap securement means attachable with respect to said second upper slits.

15. An adjustable head-of-wall insulating construction for sealing a head-of-wall area as defined in claim 14 wherein said first strap securement means comprises a first securement projection and first securement ears positionable at a location extending through said first slit and attachable with respect thereto to facilitate engagement by said first strap securement means and wherein said second strap securement means comprises a second securement projection and second securement ears positionable at a position extending through said second slit and attachable with respect thereto to facilitate engagement by said second strap securement means.

16. An adjustable head-of-wall insulating construction for sealing a head-of-wall area between a ceiling thereabove and a wall configuration therebelow which is wider than standard and which includes a ceiling track having a main track section which extends generally horizontally and a first track side section extending downwardly therefrom and a second side track section extend downwardly therefrom at a position spatially disposed from the first track section wherein the main track section includes a first track side section defining a first lowermost edge thereof and a second side track section defining a second lowermost edge thereof, said insulating gasket construction comprising:

A. a first L-shaped gasket section including:

(1) a first gasket upper panel of insulating material positioned immediately above the main track section of the ceiling track and extending generally horizontally thereover; and (2) a first gasket side panel of insulating material attached with respect to said first gasket upper panel and extending generally downwardly therefrom across the first track side section for insulating thereover, said first gasket side panel extending downwardly from said first gasket upper panel to define the generally L-shaped configuration of the first L-shaped gasket section, said first gasket upper panel and said first gasket side panel together defining a track receiving recess facing downwardly therebelow;

B. a second L-shaped gasket section including:

(1) a second gasket upper panel of insulating material positioned immediately above the main track section of the ceiling track and extending generally horizontally thereover at a position spatially disposed from said first gasket upper panel; and (2) a second gasket side panel of insulating material attached with respect to said second gasket upper panel and extending generally downwardly therefrom across the second track side section for insulating thereover, said second gasket side panel extending downwardly from said second gasket upper panel to define the generally L-shaped configuration of the second L-shaped gasket section, said second gasket upper panel and said second gasket side panel and said first gasket upper panel and said first gasket side panel together defining a track receiving recess facing downward therebelow for receiving a ceiling track positionable therewithin for facilitating insulating therearound;

C. a first panel adhesive means mounted on said first gasket upper panel at a position between said first gasket upper panel of said first L-shaped gasket section and the main track section of the ceiling track to facilitate engagement therebetween; and D. a second panel adhesive means mounted on said second gasket upper panel at a position between said second gasket upper panel of said second L-shaped gasket section and the main track section of the ceiling track to facilitate engagement therebetween;

wherein the first track side section includes a first lower edge therealong and the second track side section includes a second lower edge therealong and wherein said first gasket side panel includes at least one attachment side tab extending inwardly into said track receiving recess at a position beneath the first track side section for engagement therewith to facilitate retaining of said L-shaped gasket section adjacent the main track section wherein said second gasket side panel includes at least one attachment side tab extending inwardly into said track receiving recess at a position beneath the second track side section for engagement therewith to facilitate retaining of said L-shaped gasket section adjacent the main track section.

* * * * *